US006544713B2

(12) United States Patent
Aylward et al.

(10) Patent No.: US 6,544,713 B2
(45) Date of Patent: Apr. 8, 2003

(54) IMAGING ELEMENT WITH POLYMER NACREOUS LAYER

(75) Inventors: Peter T. Aylward, Hilton, NY (US); Narasimharao Dontula, Rochester, NY (US); Alphonse D. Camp, Rochester, NY (US); Robert P. Bourdelais, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/931,311

(22) Filed: Aug. 16, 2001

(65) Prior Publication Data

US 2003/0039930 A1 Feb. 27, 2003

(51) Int. Cl.[7] ..... G03C 1/765; G03C 1/795; G03C 1/91; G03C 1/95; G03C 8/52

(52) U.S. Cl. ..... 430/201; 430/11; 430/14; 430/220; 430/496; 430/510; 430/523; 430/533; 430/536; 347/106

(58) Field of Search ..... 430/11, 14, 220, 430/496, 523, 533, 536, 510, 961, 201; 347/106

(56) References Cited

U.S. PATENT DOCUMENTS

| | | | | |
|---|---|---|---|---|
| 4,216,018 A | | 8/1980 | Bilofsky et al. | 430/220 |
| 4,269,916 A | | 5/1981 | Bilofsky et al. | 430/220 |
| 4,288,524 A | | 9/1981 | Bilofsky et al. | 430/220 |
| 4,579,810 A | * | 4/1986 | Johnson et al. | 430/536 |
| 4,910,235 A | * | 3/1990 | Satake et al. | 523/171 |
| 5,340,692 A | | 8/1994 | Vermeulen et al. | 430/220 |
| 5,466,519 A | | 11/1995 | Shirakura et al. | 430/538 |
| 5,733,658 A | | 3/1998 | Schmid et al. | |
| 5,858,078 A | | 1/1999 | Andes et al. | |
| 5,866,282 A | | 2/1999 | Bourdelais et al. | 430/536 |
| 5,888,681 A | | 3/1999 | Gula et al. | 430/536 |
| 6,030,759 A | | 2/2000 | Gula et al. | 430/536 |
| 6,071,654 A | | 6/2000 | Camp et al. | 430/536 |
| 6,071,680 A | | 6/2000 | Bourdelais et al. | 430/536 |
| 6,274,284 B1 | | 8/2001 | Aylward et al. | |
| 6,291,551 B1 | * | 9/2001 | Kniess et al. | 430/270.1 |

FOREIGN PATENT DOCUMENTS

| | | |
|---|---|---|
| JP | 61/259246 | * 11/1986 |

OTHER PUBLICATIONS

JPAB Abstr. of JP 61/259,246, Fuchizawa et al. Nov. 1986.*

Derwent Abst of JP 61/259,246, Fuchizawa et al. Nov. 1986.*

* cited by examiner

*Primary Examiner*—Richard L. Schilling
(74) *Attorney, Agent, or Firm*—Paul A. Leipold

(57) ABSTRACT

The invention relates to an imaging element comprising at least one layer comprising nacreous pigment and polymer.

40 Claims, No Drawings

IMAGING ELEMENT WITH POLYMER NACREOUS LAYER

FIELD OF THE INVENTION

This invention relates to imaging materials. In a preferred form, it relates to nacreous imaging elements.

BACKGROUND OF THE INVENTION

Prior art reflective imaging output materials such as silver halide reflective images or ink jet reflective images typically comprise imaging layers applied to a white reflective base material. The white reflective base reflects ambient light back to the observer's eye to form the image in the brain. Prior art base materials typically utilize white reflecting pigments such as $TiO_2$ or barium sulfate in a polymer matrix to form a white reflective base material. Prior art reflective photographic papers also contain white pigments in the support just below the silver halide imaging layers to obtain image whiteness and sharpness during image exposure, as the white pigment reduces the amount exposure light energy scattered by the cellulose paper core. Details on the use of white pigments in highly loaded coextruded layers to obtain silver halide image sharpness and whiteness are recorded in U.S. Pat. No. 5,466,519.

In addition to the use of white pigments in reflective consumer photographs, white pigments are also utilized in photographic display materials for diffusion of illumination light source. While the use of white pigments in display materials does provide the desired diffusion and reflection properties, the white pigments tend to change the hue angle of the color dyes in a developed photographic display image. Dye hue angle is a measure in ClElab color space of that aspect of color vision that can be related to regions of the color spectrum. For color photographic systems there is a perceptual preferred dye hue angle for the yellow, magenta, and cyan dyes. It has been found that when photographic dyes are coated on support containing white pigments, the hue angle of the developed image changes compared to the hue angle of the dyes coated onto a transparent support. The hue angle change of photographic dyes caused by the presence of white pigments often reduces the perceived quality of the dyes compared to the dye set coated on a transparent base that is substantially free of white pigments. It would be desirable if a developed photographic dye set coated on a reflective support material had a dye hue angle that was not significantly different than the same dye set coated on a transparent support.

It has been proposed in U.S. Pat. No. 5,866,282 (Bourdelais et al) to utilize a composite support material with laminated biaxially oriented polyolefin sheets as a photographic imaging material. In U.S. Pat. No. 5,866,282, biaxially oriented polyolefin sheets are extrusion laminated to cellulose paper to create a support for silver halide imaging layers. The biaxially oriented sheets described in U.S. Pat. No. 5,866,282 have a microvoided layer in combination with coextruded layers that contain white pigments such as $TiO_2$ above and below the microvoided layer. The composite imaging support structure described in U.S. Pat. No. 5,866,282 has been found to be more durable, sharper and brighter than prior art photographic paper imaging supports that use cast melt extruded polyethylene layers coated on cellulose paper.

It has been proposed in U.S. Pat. No. 6,071,680 (Bourdelais et al) to utilize a voided polyester sheet coated with light sensitive silver halide imaging layers for use as photographic output material. The voided layer in U.S. Pat. No. 6,071,680 improves opacity, image lightness, and image brightness compared to prior art polyethylene melt extrusion coated cellulose paper base materials. The image base proposed in U.S. Pat. No. 6,071,680 also contains an integral polyolefin skin layer to facilitate imaging layer adhesion at the time of manufacture and during the processing of silver halide imaging layers.

There, however, remains a continuing need for improvements to the appearance of imaging output materials. It has been shown that consumers, in addition to reflective output material, also prefer nacreous images. Nacreous images exhibit a pearly or nacreous luster, an iridescent play of colors, and a brilliant luster that appears in three dimensions. Nacreous appearance can be found in nature if one examines a pearl or the polished shell of Turbo marmoratus.

A nacreous photographic element with a microvoided sheet of opalescence is described in U.S. Pat. No. 5,888,681 (Gula et al). In U.S. Pat. No. 5,888,681 microvoided polymer sheets with microvoided polymer layer located between a cellulose paper base and developed silver halide imaging provide an image with an opalescence appearance. The nacreous appearance is created in U.S. Pat. No. 5,888,681 by providing multiple internal reflections in the voided layer of the polymer sheet. While the opalescence appearance is present in the image, the image suffers from a loss of image sharpness or acutance, a higher density minimum position, and a decrease in printing speed compared to a typical photographic image formed on a white, reflecting base. It would be desirable if the opalescent look of the image could be maintained while improving printing speed, increasing sharpness, and decreasing density minimum. Also, while the voided polymer does provide an excellent nacreous image, the voided layer, because it is pre-fractured, is subjected to permanent deformation, thus reducing the quality of the image.

Nacreous pigments added to a matrix, such as paint or plastic, have been known to exhibit a nacreous appearance. The prior art use of the nacreous pigments have been for pigmenting paints, printing inks, plastics, cosmetics, and glazes for ceramics and glass. Nacreous pigments are dispersed in a matrix and then painted or printed onto a substrate. Pearl luster pigments containing titanium dioxide have been successfully employed for many years. They are constructed in accordance with the layer substrate principle, with mica being employed virtually without exception as substrate.

Mica pigments are used widely in the printing and coating industries, in cosmetology, and in polymer processing. They are distinguished by interference colors and a high luster. For the formation of extremely thin layers, however, mica pigments are not suitable, since the mica itself, as a substrate for the metal-oxide layers of the pigment, has a thickness of from 200 to 1200 nm. A further disadvantage is that the thickness of the mica platelets within a certain fraction defined by the platelet size in some cases varies markedly about a mean value. Moreover, mica is a naturally occurring mineral which is contaminated by foreign ions. Furthermore, technically highly complex and time-consuming processing steps are required including, in particular, grinding and classifying.

Pearl luster pigments based on thick mica platelets and coated with metal oxides have, owing to the thickness of the edge, a marked scatter fraction, especially in the case of relatively fine particle-size distributions below 20 micrometers. As a substitute for mica, it has been proposed to use thin glass flakes which are obtained by rolling a glass melt with subsequent grinding. Indeed, interference pigments based on such materials exhibit color effects superior to those of conventional, mica-based pigments. Disadvantages, however, are that the glass flakes have a very large mean thickness of about 10–15 micrometers and a very broad thickness distribution (typically between 4 and 20 micrometers), whereas the thickness of interference pigments is typically not more than 3 micrometers.

In U.S. Pat. No. 4,269,916 (Bilofsky et al) and related patents U.S. Pat. No. 4,288,524 and U.S. Pat. No. 4,216,018, instant photographic products having reflective layers which comprise lemellar interference pigments are disclosed. The intended use of the lemellar pigments is to create a pleasing white reflective appearance for the base material without the need for blue tints. It has been proposed that flat particles of metal oxides created by coating salts with metal oxides and later dissolving the salts leaving a thin flake of metal oxide as a substitute for spherical $TiO_2$ particles. Titanium dioxide particles typically are utilized in photographic art to create a white reflective surface for the viewing of print materials. The intent of U.S. Pat. No. 4,269,916 is to provide a white reflecting surface that does not have an angular viewing appearance and a consistent L*, thus the invention materials do not exhibit a nacreous appearance. Examples in U.S. Pat. No. 4,269,916 show high reflectivity at a variety of collection angles which is opposite of a nacreous appearance where reflectivity changes as a function of collection angle. Further, the lemellar pigments are not present in the silver halide imaging layers or in the base materials used in the invention.

In U.S. Pat. No. 5,858,078 (Andes et al), a process for the production platelet like, substrate free $TiO_2$ pigment is disclosed for use in printing inks, plastics, cosmetics and foodstuffs.

In U.S. Pat. No. 5,340,692 (Vermeulen et al) an image receiving material with nacreous pigment for producing contone images according to the silver salt diffusion process is disclosed. According to the process disclosed in U.S. Pat. No. 5,340,692, contone images with an antique look can be obtained utilizing the silver salt diffusion transfer process without the need of special processing liquids using a nacreous pigment in the image receiving layer or located between the support and the image receiving layer. The silver halide imaging layers used are created with retained silver and, therefore, are not semitransparent. Because the nacreous pigments used are contained in the image receiving layer and not silver halide imaging layer, the image form will not have a uniform nacreous appearance, as the density of the transferred silver halide image blocks the multiple reflections from the nacreous pigments. Further, the nacreous pigments utilized are too large and in too great a concentration to be included in the silver halide imaging layer as a rough surface would result, reducing the desired nacreous appearance of the image. The gold flakes used in the example in U.S. Pat. No. 5,340,692 are an attempt to simulate prior art black-and-white photographic "Sepatone" appearance produced during a post process treatment of the imaging layers. While the image in the example does have an antique appearance, the image does not have a nacreous appearance.

In U.S. Pat. No. 5,733,658 (Schmid et al) luster pigments obtainable by creating titania coated silicate based platelets from 400° C. to 900° C. with a gas mixture comprising a vaporized organic compound and ammonia are described as useful for coloring paints, inks, plastics, glasses, ceramic products, and decorative cosmetic preparations.

When imaging supports are subject to variations in ambient conditions over long periods of time, the image-containing layers and resin layers tend to deteriorate into a mass of cracks which are aesthetically undesirable and which, in extreme cases, extend over the entire print completely destroying the image. All polymers are inherently prone to chemical degradation that leads to loss of mechanical properties. They undergo thermal degradation during processing such as extrusion of thin films, and photooxidative degradation with long-term exposure to light. The $TiO_2$ utilized in U.S. Pat. No. 5,858,078 and U.S. Pat. No. 5,733,658 catalyzes and accelerates both thermal and photooxidative degradation. In the art of resin coating imaging papers, the melt polymers are extruded at high temperatures and are also subjected to high shear forces. These conditions may degrade the polymer, resulting in discoloration and charring, formation of polymer slugs or "gels", and formation of lines and streaks in the extruded film from degraded material deposits on die surfaces. Also, thermally degraded polymer is less robust than non-degraded polymer for long-term stability, and may thereby shorten the life of the print.

It has been shown that when imaging layers (silver halide, ink jet, flexography, laser toner, and the like) are applied to nacreous base materials, the nacreous appearance of the image is optimized when the image forming layers contain semitransparent dyes. The use of pigmented inks and dyes in the imaging layers tend to reduce the nacreous appearance of the image. In U.S. Pat. No. 6,071,654 (Camp et al) silver halide imaging layers that are semitransparent are coated on a nacreous support containing a voided polymer layer. The voided polymer layers create flat platelets oriented parallel to each other. The reflection which reaches the eye is primarily specular. It arises in depth, since each transparent polymer platelet reflects some of the incident light and reflects the remainder. The images in U.S. Pat. No. 6,071,654 exhibit a nacreous appearance.

PROBLEM TO BE SOLVED BY THE INVENTION

There is a need for a reflective imaging material that provides a nacreous or pearlscent appearance. There is also a need to provide a means to easily provide a nacreous appearance to an image materials while maintaining good image sharpness or printing speed.

SUMMARY OF THE INVENTION

It is an object of the invention to improved imaging materials

It is another object to provide imaging materials with improved image appearance.

It is a further object to provide imaging materials that have a nacreous appearance.

These and other objects of the invention are accomplished by an imaging element comprising at least one layer comprising nacreous pigment and polymer.

ADVANTAGEOUS EFFECT OF THE INVENTION

The invention provides brighter, snappy images that sparkle while having exceptional photographic sharpness and exposure speed. Further the images have a desirable nacreous appearance that provides a unique appearance to imaging products.

DETAILED DESCRIPTION OF THE INVENTION

The invention has numerous advantages over prior art photographic reflective materials. The reflective materials of the invention provide an image with a nacreous appearance while maintaining efficient reflection of light, sharpness, and photographic speed. Maintaining image sharpness and whiteness is important, as consumers expect silver halide images to be high in quality. Further, maintaining printing speed is critical for efficient photographic processing, as a significant loss in printer speed could increase the cost of consumer silver halide images.

The nacreous imaging materials of the invention provide an eye-catching appearance that make them particularly desirable in imaging applications that require capturing the attention of the consumer. One example includes display materials that are intended to communicate an advertising message to people in a public setting such as a bus stop, train station, or airport. The nacreous images are differentiated in look from prior art materials and, thus, provide the pop and sizzle that can catch the consumer's attention. By providing the nacreous image with a pressure sensitive adhesive, the tough, durable nacreous image can be applied to various surfaces, which is particularly desirable for the youth market.

Photographic nacreous labels suitable for use in the packaging markets enable a differentiated look and consumer appeal on store shelf. The utilization of the thin, flexible, and tough silver halide materials results in a packaging material having many superior properties. These packaging materials may have a depth of image unsurpassed by existing packaging materials. The packaging materials of the invention may be utilized with a variety of packaging materials that are suitable for pressure sensitive labeling, such as shampoo bottles, perfume bottles, and film boxes. The packaging materials suitable for use in this invention, while having the advantage of superior image, are available on thin base materials which are low in cost while providing superior opacity and strength. The packaging materials of the invention, as they may be imaged by flash optical exposure or digital printing, have the ability to be formed in short runs and to be rapidly switched from one image to the next without delay.

The term "nacreous" refers to a pearly, luster, and nacreous appearance. This may include a metallic, lustrous, and somewhat iridescent effect. The nacreous effect is the result of interference pigments that are platelet-like in their structure. Typically these are elongated platelet-like structures of silicate-based materials such as mica, feldspar, and quartz. These pigments tend to cause specular and diffuse reflection, and they also transmit some light. The use of nacreous pigments in the paint and printing industry are typically designed to create a variety of eye-popping colors. These materials are typically coated over dark black backgrounds to help accentuate the eye-popping optical effects. Special metal oxide coatings are applied to mica particles in very thin layers. This allows for some light to be refracted, while other light will transmit through to the near transparent layers of the mica particle to be refracted at a slightly different angle. Since these pigments are suspended in a binder polymer of yet another refractive index, there are multiple light refractions that create a lustrous appearance. In addition, the chemistry of the coating that is applied to the mica particles may be varied to create various colors. Metal oxide coatings that may be used in an embodiment of this invention include titanium, iron, chromium, barium, aluminum, zinc, zirconium, bismuth vanadate, nickel titanate, chromium titanate, lead, and others. While these produce some exciting colors in the field of photography and imaging, traditional print materials have a white background. Additionally, it should be noted that the thickness of the metal oxide coating on the mica may also impact the color. In a preferred embodiment of this invention the metal oxide coating on the mica particles may comprise titanium, aluminum, and/or barium. These materials are preferred because it is desirable to have a more traditional white background than can be achieved with these materials. The most preferred metal oxide is titanium because of its superior whiteness. Typically it is important to control the thickness of the metal oxide coating to less than 120 nanometers to achieve a blue white appearance.

With nacreous pigments used in imaging application, it may be desirable to have non-uniform platelet thickness and small particles to create a white nacreous appearance. In imaging application where a different look is desirable, the use of thicker particles and more uniform spacing of platelets to each other creates a color interference that is more characteristic of mother-of-pearl. In general, the lustrous pigments referred to in this invention are pigments that consist of flat mica platelets coated with titanium dioxide or other metal oxides. They are irregular in shape and may vary in thickness from 0.1 to 0.5 micrometers, although some individual particles may be thicker. The particles may have a length of up to 500 micrometers. The coating applied to the mica particles should be controlled in thickness, but the overall thickness is one parameter that controls the overall color appearance. Each transparent coating helps to create the lustrous or pearlescent effect. The coating of these pigments influences the perceived texture of the pearl luster effect and adds a new dimension of beauty and quality to the image. The coating may be colored with other compatible transparent pigments and dyestuffs. Metallic effects can be simulated by adding small amounts of carbon black with some silvery white pigments. The color observed is different than color pigments and dyes in that the color and lustrous iridescence is produced by light interference and not absorption or reflection of light. This is a suprisingly unique attribute to the field of silver halide photography and imaging. With the use of nacreous pigments there are many refractive interfaces that can produce a unique appearance to an imaging element. A light ray striking a layer containing nacreous platelets must pass through a substantially transparent layer of relatively lower refractive index binder polymer surrounding the platelet, and then the ray is then partially reflected by the metal oxide coating on the surface. The remaining part passes into the metal oxide coating layer and is again reflected as it exits the layer at the interface with the mica particle. Since the coating is very thin and the mica platelets are substantially transparent, the remaining light has many opportunities to be reflected at different angles. This helps to provide the lustrous nacreous appearance, as well as to add a three-dimensional quality to the image. The resulting color effect that is produced depends on the light reflection from the interfaces, as well as the type of coating on the mica particles. The multiple interfaces cause the reflected light to be slightly out of phase. It should also be noted that the color varies based on the angle of illumination and that an iridescence effect can be seen. Control of this effect is desirable depending on the effect that needs to be conveyed by the image. As noted above the thickness and type of the coating on the mica particles are factors that need to be considered. In addition the particle size can also be used to control the effect. For use in a photographic element it is desirable to have a smooth surface. To achieve this, a small particle is best but the layer thickness of the binder polymer in which the pigments are suspended may also be increased as well as applying clear overcoats. Larger particles are desirable when a bold effect with visual impact is desired. The nacreous effect can be changed by adjusting the particle size, metal oxide coating thickness and type, as well as the concentration of the pigment. In general, low pigmentation levels are better at producing a three-dimensional effect. This effect may be enhanced by applying a thick clear layer over the top of the nacreous pigments. When a more metallic sheen is desired, higher pigmentation levels are best. It should also be noted that different effects may be achieved by adding other transparent pigments and dyes in the layers. Since light sensitive photographic layers produce dye couplers that are semitransparent and typically do not contain pigment particles; they are uniquely positioned to be able to create synergistic effects with the nacreous pigments.

The nacreous pigments are relatively stable and generally resistant to alkali and acids, as well as high temperature. They can be dispersed in most carrying (binder polymer) media. Since the particles are substantially transparent, the use of a carrying media that is also transparent provides the maximum effect. If a more translucent carrying media is used, more nacreous pigment may be needed to achieve the same level of nacreous appearance.

In some applications it may be desirable to also have a nacreous pigment that is also conductive. This has some unique advantages in the area of photography that uses light sensitive layers. Static accumulation and discharge can result in a fogged layer. Being able to provide a conductive path that helps to prevent the charge from building up is an important element for imaging media. This not only helps prevent light fogging of light sensitive layer, but also allows sheets to slide over each other and various equipment parts without static buildup or cling of one sheet to another. This type of pigment is also a means of adding conductivity to the emulsion side of a photographic element. Conductive nacreous pigments consist of an inter core of platelet mica that is coated with materials such as $TiO_2$, $SiO_2$ and further coated with an outer layer of dense layer of conductive, inorganic mixed metal oxide. A typical material is antimony-doped tin dioxide. The elongated particles of mica are useful in providing a conductive pathway when particles are touching.

The origin of the beauty of a genuine pearl has been well documented. It is known that its luster and color come from the multiple smooth concentric layers of nacre, i.e., calcium carbonate layer, organic constituent (conchiolin) layer. Each of these layers partially reflects and transmits light. Hence, a sense of depth and luster is observed in the reflection. Pigments that try to simulate the visual effect of a pearl are called as pearlescent or nacreous pigments. The first nacreous pigment was the natural pearl. The commercial grades of nacreous pigments are made of thin transparent platelets of high refractive index. These pigments are so designed that multiple reflections and transmissions occur and, as a result, a sense of depth is obtained in the overall reflected image. The characteristics of the pigment determine whether color is produced by light interference (specifically called as interference pigments) or no color is produced (called as white nacreous pigments).

Some of the earliest pearlescent pigments were the platelike bismuth oxychloride crystals, and basic lead carbonate. These pigments reflect light similar to a pearl essence crystal. Due to toxicity of lead, bismuth oxychloride (BiOCl) crystals have seen an increased use in the marketplace. BiOCl is generally crystallized from solution into smooth, thin platelets which has a particle size ranging from 5 micrometer and 15 micrometer.

The other commonly used pearlescent pigments are those made from mica coated with either titanium dioxide (U.S. Pat. No. 4,040,859), iron oxide (U.S. Pat. No. 3,087,829), zirconium dioxide (U.S. Pat. No. 3,087,828), or other high refractive index materials. Mica is used because it is transparent to light and can be cleaved into extremely thin flakes. Examples of mica suitable for pearlescent pigments are muscovite, paragonite, phlogopite, biotite, and lepidolite. The mica platelets are then coated with a thin single layer or multiple layers of high refractive index inorganic oxide. The reflection efficiency depends to a large extent on the refractive index difference between the mica platelet and the inorganic oxide coating. This layered structure enables it to function like a pearlescent pigment. The oxide coating provides the optical effects like luster, interference reflection color (if oxide coating is sufficiently thick) and absorption color (if the oxide contains color material). The size of the mica particle also plays an important role in determining the final reflected image. The weight of the mica in the pigment usually lies between 40% and 90% and most usually in the range of 60% and 80%. If titanium dioxide is used as the coating and its coating thickness is increased, then an iridescence effect (color) is observed. The longest dimensions of pearlescent pigments used in this invention may be between 5 micrometer and 400 micrometer and preferably between 5 micrometer and 100 micrometer because particles less than 5 micrometer are not very efficient in creating the nacreous appearance, while particles greater than 100 micrometer progressively get rougher. Excessive roughness on the surface tends to shut down the nacreous appearance. The thickness of the pigment is preferably between 0.1 micrometer and 0.6 micrometer and more preferably between 0.2 micrometer and 0.4 micrometer. Particles less than 0.2 micrometer typically do not have sufficiently high nacreous appearance, while particles greater than 400 micrometer in length or 0.6 micrometer in width typically are very large and tend to create roughness in the polymer layer which starts to shut down the nacreous effect.

Other optically variable pigments that are suitably used are silicon oxide coated with thin layers of aluminum (5 nanometer and 10 nanometer) or titanium dioxide, and magnesium fluoride crystals coated with chromium have also been used. These pigment structures have been highlighted in U.S. Pat. No. 3,438,796. New optically variable pigment structures based on coated platelet like metallic substrates have been disclosed in U.S. Pat. No. 5,364,467 and U.S. Pat. No. 5,662,738. U.S. Pat. No. 5,976,511 discloses pigments composed of barium sulfate particles and coated with zinc oxide, cerium oxide, or titanium dioxide which have a pearly luster.

The photographic elements of this invention may utilize an integral emulsion bonding layer that allows the emulsion to adhere to the support materials during manufacturing and wet processing of images without the need for expensive subbing coatings.

The terms as used herein, "top", "upper", "emulsion side", and "face" mean the side or toward the side of an imaging member or photographic member bearing the imaging layers or image receiving layer. The terms "bottom", "lower side", and "back" mean the side or toward the side of the photographic member or imaging member opposite from the side bearing the photosensitive imaging layers or developed image. Nacreous appearance is a pearly, luster, iridescent, metallic sheen. A characteristic property of a nacreous appearance is an angular dependence of viewing angle.

Conventional resin coated photographic paper support materials generally consist of a base paper with polymer resin coatings on both sides. The polymer resin coatings on the base paper can consist of a polyolefin, such as polyethylene or polypropylene and are generally applied to the paper by means of an extrusion coating process. This may be either a single layer of polymer or multiple coextruded layers. Polyolefins are desired because they are relatively inexpensive, nacreous pigments are also readily dispersed in polyolefins and extrusion coated. Polyolefin and in particular polyethylene is preferred to be in contact with a photographic emulsion to enhance adhesion.

One or several light sensitive coatings based on silver halides are applied to one of the polymer resin layers. The light sensitive layers can be black and white, as well as color photographic layers.

The polymer resin film (back side coating) positioned on the paper side which is opposite the light-sensitive layers, can be pigmented or unpigmented and/or contain other additives and may be one or more layers. This layer can be coated with one or more further functional layers, e.g. layers for recordability, anti-static layer, sliding layer, adhesive layer, anti-curl layer or anti-halation layer.

The coating of a photographic base paper with polyolefin by extrusion through a T-die is a process that is known. The polyolefin extrusion coating takes place at a point where the paper web enters the nip between the chill roll and a rubber roll through which the polyolefin film is adhered to the paper web. The chill roll also serves for the formation of the surface structure of the polyolefin layer. Corresponding to the composition of the chill roll surface, e.g. glossy, dull or structured (for example, silk-like), polyolefin surfaces can be produced.

A most important constituent in the front face coating situated between the base paper and photosensitive coatings is, apart from the water-repellent polymer resin binder, the light-reflecting white pigment. This white pigment is determining not only for the visual impression of a photographic image, but also for the imaging quality and the durability of the photographic image produced in the adjoining photographic layers. A number of publications and inventions, therefore, concern themselves with the pigmenting of this water-repellent front face coating of the paper support. In particular the pigmenting of a front face coating based upon polyolefin and applied by extrusion coating, is the subject of a number of investigations.

The polymer resin coating (front side coating) positioned under the light sensitive layer or imaging layer usually contains light reflecting white pigment, as well as coloring pigments, optical brighteners and, if necessary, other additives such as antistatic agents, dispersing agents for the pigment, etc. Typical white pigments include $TiO_2$, $BaSO_4$, $CaCO_3$, talcs, clays, ZnO, ZnS and other pigments known in the art. The resin coated layer may also be one or more layers preferably below the nacreous particle containing layer(s). The pigment containing polyolefin-coating material can be applied onto one or both sides of the paper. It consists essentially of a polyolefin (80–95% by weight), a titanium dioxide (20–5% by weight) and of an addition according to the present invention of 0.05–20% by weight of an alkaline earth carbonate or oxide. In conventional photographic resin coated paper, titanium dioxide is used because of its high refractive index, which gives excellent optical properties at a reasonable cost. The pigment is used in any form that is conveniently dispersed within the polyolefin. Anatase titanium dioxide is used when the overall lightness and brightness is desired in the product. Rutile titanium dioxide is used because it has the highest refractive index at the lowest cost. The high refractive index is used when image sharpness is desired. The average pigment diameter of the rutile $TiO_2$ is in the range of 0.1 to 0.26 micrometer. The pigments that are greater than 0.26 micrometer are too yellow for an imaging element application and the pigments that are less than 0.1 micrometer are not sufficiently opaque when dispersed in polymers. The white pigment should be employed in the range of from about 10 to about 50 percent by weight, based on the total weight of the polyolefin coating. Below 10 percent $TiO_2$, the imaging system will not be sufficiently opaque and will have inferior optical properties. Above 50 percent $TiO_2$, the polymer blend is less manufacturable. The surface of the $TiO_2$ can be treated with an inorganic compound such as aluminum hydroxide, alumina with a fluoride compound or fluoride ions, silica with a fluoride compound or fluoride ion, silicon hydroxide, silicon dioxide, boron oxide, boria-modified silica (as described in U.S. Pat. No. Pat. No. 4,781,761), phosphates, zinc oxide, $ZrO_2$, etc. and with organic treatments such as polyhydric alcohol, polyhydric amine, metal soap, alkyl titanate, polysiloxanes, silanes, etc. The organic and inorganic $TiO_2$ treatments can be used alone or in any combination. The amount of the surface treating agents is preferably in the range of 0.2 to 2.0% for the inorganic treatment and 0.1 to 1% for the organic treatment, relative to the weight of the weight of the titanium dioxide. At these levels of treatment the $TiO_2$ disperses well in the polymer and does not interfere with the manufacture of the imaging support. When high loadings of pigment are desired, it may be beneficial to use a coextrusion process in which one or more layer are extruded with a multi-slot die or feed block arrangement. The value of multi layers is that it allows layers with high pigment high loading that may be weak and unstable to the extrusion processing and coating conditions to be coated with other layers with little or no loading that provide the required strength.

For the purpose of this invention the term polymer unless otherwise defined refers to a melt extrudable resin such as polyolefins polyesters and their copolymers and combinations thereof.

In a preferred embodiment of this invention in which an imaging element is resin coated with nacreous pigments and polymer, the resin polymer layer should otherwise be substantially free of other pigments. That is the carrying polymer should be clear. Light absorbing and reflecting white pigments in the same layer or in layers above the nacreous pigment will markedly reduce or shutdown the nacreous appearance.

In this invention the imaging element comprising at least one layer containing nacreous pigment and polymer has a nacreous appearance. Having an imaging element with a nacreous appearance provides a unique appearance to the image that is useful in imaging prints and advertising. This unique appearance adds value and is very eye catching which is critical to drawing people's attention to the message in the advertising. Such an imaging element has a unique capability to preserve images with special luster sheen that is not available in traditional photographs or commercial displays. A preferred embodiment of this invention comprises at least two layers containing nacreous pigment. The nacreous pigment may be in at least one image layer and in at least one additional resin coated layer that comprises a nacreous pigment and polymer. These embodiments are preferred because they provide a unique combination of nacreous appearance in both the image layer as well as the support substrate. By having more than one layer containing nacreous pigment, different pigments and particle size may be used to further optimize the imaging element.

In a preferred embodiment of this invention the imaging element comprises at least one layer comprising nacreous pigment and polymer. This embodiment is preferred because it provides a means to incorporate a nacreous pigment in a polymer in the imaging element. In the case of when the imaging layer is a silver halide layer, it allows the light to pass through and expose the image layer without scattering the light. In the case when the image layer is inkjet, thermal dye transfer, electrophotographic or other image receiving layer, having a nacreous pigment in a polymer layer provides an element that has a nacreous effect.

In an additional embodiment of this invention the imaging element comprising at least one layer comprising nacreous pigment and polymer further comprises a substrate. Any base substrate may be used in this invention. This includes but is not limited to resin coated paper and in particular photographic resin coated paper, polyester, biaxially oriented polymer sheets laminated to paper, polyester or other suitable polymer sheet, paper, polymer coated paper, synthetic paper and others. In one embodiment of this invention the nacreous pigment is the surface layer of the substrate. The nacreous pigment may be integral to the base substrate such as paper that has been surface sized or otherwise applied to top portion of the substrate. In a further embodiment of this invention, at least one layer comprising nacreous pigment is in at least one layer adjacent the surface layer of the substrate. That is the nacreous pigment may be in an imaging layer adjacent to the substrate or below a clear layer comprising the substrate or in combination with the base substrate and the image receiving layer.

In order to maximize the nacreous effect of this invention, an additional preferred embodiment has the nacreous pigment in the upper part of said substrate. This embodiment is preferred because it provides a means to provide the nacreous effect separate to or in combination with the image layers. In yet an additional preferred embodiment of this invention, at least one reflective layer is below the layer comprising a nacreous pigment. Having a reflective layer below the nacreous pigment allows light to be reflected back to the viewer to enhance the nacreous appearance. In the case of a photographic imaging element, the reflective layer provides additional exposure and therefore reduces the light intensity for exposure or the amount of time required for an acceptable image. The preferred reflective layer may further comprise a white pigment such as $TiO_2$, $BaSO_4$, clay, talc, $CaCO_3$, ZnO, ZnS or other white pigments known in the art. Said reflective layer may also further comprise tinting aids, optical brighteners or other functional addenda. In some cases in may be desirable to add a small amount of brightener to the layer that comprises a nacreous pigment.

In yet another preferred embodiment of this invention the nacreous pigment is in at least one layer adjacent to the surface layer of said substrate. This provides a smooth surface for the imaging layers and therefore allows a wider range of larger nacreous pigment particles to be used. The layer that is adjacent to the image layer should be substantially free of pigment. Having a clear layer on top of the nacreous layer provides a means to control roughness and add gloss to the imaging element. Additionally having the nacreous pigment in a layer that is substantially free of other light scattering pigments provides a layer that will minimize unwanted light scattering and absorption. In this embodiment, the surface layer has a surface roughness of less than 0.8 micrometer. Surface roughness below 0.8 micrometer is preferred because it provides exceptional gloss and snap to the image. When the surface roughness is greater than 0.8 micrometers the added roughness starts to reduce the overall snap of the nacreous image.

The nacreous pigment layer of this invention is present in said imaging element in an amount between 0.5 and 8% by volume of the layer comprising a nacreous pigment. In a preferred embodiment of this invention the said at least one layer comprising a nacreous pigment has a ratio of layer thickness to average size of the longest dimension of said nacreous pigment of between 2 to 1 and 10 to 1. When the ratio is less than 2 to 1, there is typically not sufficient polymer volume to provide the desired smoothness and therefore the snap is reduced. As the ratio becomes greater than 10 to 1, the surface layer does not substantially get smoother or more nacreous in appearance for the added thickness. Additional if the layer becomes to thick, the nacreous appearance becomes diluted and less effective.

In an additional embodiment of this invention at least two layers comprise a nacreous pigment. This embodiment allows for the imaging element to have nacreous pigment in at least two layers. This may include two or more in the base substrate, two or more in the imaging layers or a combination thereof. This provides the ability to use nacreous pigments of different composition in different or the same layer. Being able to use different particle sizes or type of nacreous pigments is preferred because it provides flexibility in the effect that can be created. Being able to use a small particle size in the image layer versus the substrate provides improved design space for layer thickness and helps to minimize light scattering. This helps to maximize the smoothness of the support that enhances the effect of the nacreous effect.

The nacreous pigment of the above invention embodiment comprises at least one member selected from the group consisting of metal oxide coated mica, modified mica, fledspar, silicates and quartz. The preferred embodiment of this invention comprises silicates. Silicates are preferred because they are general flat platelet or needle shape that may be coated with various metal oxides. In order to provide the nacreous appearance, the nacreous pigments may be selected from the group consisting of silicates having a coating which has a refractive index greater than 0.2 above the refractive index of the silicates. The most preferred silicates are those coated with metal oxides that provides a white appearance to the image Dmin areas or substrate. Typical metal oxide coatings include titanium, aluminum, and/or barium.

In a preferred embodiment of this invention at least one surface layer comprising nacreous pigment on the surface of the substrate has a reflecting layer below the nacreous layer. Having a reflecting layer and preferable a white reflecting background is desirable for imaging prints because it provides a traditional look as well as a good contrast to the nacreous layer and image colors. It is desirable to have a white reflective substrate that has an L* of greater than 92. Furthermore it is desirable to have an imaging element that has a b* less than 10. In the area of advertising, having a white background is not as critical but still desirable. Highly reflective whites are highly desirable from a final consumer standpoint. L* or lightness and opacity were measured for using a Spectrogard spectrophotometer, CIE system, using illuminant D6500.

In the preferred embodiment of this invention the imaging element comprising at least one layer comprising nacreous pigment and polymer further comprises a polymer selected from the group consisting of polyolefin, polyester, polycarbonate, polyamide and copolymer derivatives thereof as well as blends. Polyolefin are desired because it is easy to disperse nacreous pigments into the polymer matrix and such a layer provides the nacreous appearance. The extrusion of polyolefins containing nacreous pigments may be done in one or more layers. Coextrusion of more than one layer provides the ability to provide a clear, smooth layer on top of the nacreous layer which tends to enhance the nacreous appearance. Since nacreous particles tend to be relatively large, the use of extruded layer provides a means to control the ratio of polymer layer thickness to the longest dimension of the nacreous particle.

The dye receiving layer or DRL for ink jet imaging may be applied by any known methods. Such as solvent coating, or melt extrusion coating techniques. The DRL is coated over the tie layer (TL) at a thickness ranging from 0.1–10 um, preferably 0.5–5 um. There are many known formulations which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al., in U.S. Pat. Nos. 4,879,166, 5,14,730, 5,264,275, 5,104,730, 4,879,166, and Japanese patents 1,095,091, 2,276,671, 2,276,670, 4,267,180, 5,024, 335, 5,016,517, discloses aqueous based DRL formulations comprising mixtures of psuedo-bohemite and certain water soluble resins. Light, in U.S. Pat. Nos. 4,903,040, 4,930,041, 5,084,338, 5,126,194, 5,126,195, 5,139,8667, and 5,147, 717, discloses aqueous-based DRL formulations comprising mixtures of vinyl pyrrolidone polymers and certain water-dispersible and/or water-soluble polyesters, along with other polymers and addenda. Butters, et al., in U.S. Pat. Nos. 4,857,386, and 5,102,717, disclose ink-absorbent resin layers comprising mixtures of vinyl pyrrolidone polymers and acrylic or methacrylic polymers. Sato, et al., in U.S. Pat. No. 5,194,317, and Higuma, et all., in U.S. Pat. No. 5,059,983, disclose aqueous-coatable DRL formulations based on poly (vinyl alcohol). Iqbal, in U.S. Pat. No. 5,208,092, discloses water-based IRL formulations comprising vinyl copolymers which are subsequently cross-linked. In addition to these examples, there may be other known or contemplated DRL formulations that are consistent with the aforementioned primary and secondary requirements of the DRL, all of which fall under the spirit and scope of the current invention.

The preferred DRL is a 0.1–10 um DRL which is coated as an aqueous dispersion of 5 parts alumoxane and 5 parts poly (vinyl pyrrolidone). The DRL may also contain varying levels and sizes of matting agents for the purpose of controlling gloss, friction, and/or finger print resistance, surfactants to enhance surface uniformity and to adjust the surface tension of the dried coating, mordanting agents, anti-oxidants, UV absorbing compounds, light stabilizers, and the like.

Although the ink-receiving elements as described above can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118, 5,027,131, and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C. printer. However, it is intended that alternative embodiments of the image-recording elements as described above, which may be formulated for use with inks which are specific to a given ink-recording process or to a given commercial vendor, fall within the scope of the present invention.

The thermal dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof The dye image-receiving layer may be present in any amount which is effective for the intended purpose. In general, good results have been obtained at a concentration of from about I to about 10 $g/m^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye-containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228.

As noted above, dye-donor elements are used to form a dye transfer image. Such a process comprises image-wise-heating a dye-donor element and transferring a dye image to a dye-receiving element as described above to form the dye transfer image.

In a preferred embodiment of the thermal dye transfer method of printing, a dye donor element is employed which compromises a poly-(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS001), a TDK Thermal Head F415 HH7- 1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in detail in many books and publications. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photorecptors.

In one form of the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In one form of the electrophotographic process, a photosensitive element is permanently imaged to form areas of differential conductivity. Uniform electrostatic charging, followed by differential discharge of the imaged element, creates an electrostatic image. These elements are called electrographic or xeroprinting masters because they can be repeatedly charged and developed after a single imaging exposure.

In an alternate electrographic process, electrostatic images are created iono-graphically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent these toners form a film bonded to the paper. For heat-fusible toners, thermoplastic polymers are used as part of the particle. Heating both removes residual liquid and fixes the toner to paper.

In the case in which a light sensitive silver halide emulsion is the image receiving layer of the imaging element with at least one layer of nacreous pigment and polymer, the following disclosure provides an example. The example is described in *Research Disclosure*, September. 1994, Item 36544, Section I, published by Kenneth Mason Publications, Ltd., Dudley Annex, 12a North Street, Emsworth, Hampshire PO10 7DQ, ENGLAND.

The following examples illustrate the practice of this invention. They are not intended to be exhaustive of all possible variations of the invention. Parts and percentages are by weight unless otherwise indicated.

EXAMPLES

Example 1

Example 1 (Control) is representative of the prior art and is presented here for comparison purposes. It comprises a photographic paper with a photographic rawbase made using a standard fourdrinier paper machine utilizing a blend of mostly bleached hardwood Kraft fibers. The fiber ratio consisted primarily of bleached poplar (38%) and maple/beech (37%) with lesser amounts of birch (18%) and softwood (7%). Acid sizing chemical addenda, utilized on a dry weight basis, included an aluminum stearate size at 0.85% addition, polyaminoamide epichlorhydrin at 0.68% addition, and polyacrylamide resin at 0.24% addition. Titanium dioxide filler was used at 0.60% addition. Surface sizing using hydroxyethylated starch and sodium bicarbonate was also employed. This rawbase was then extrusion coated using a face side composite comprising substantially 83% LDPE, 12.5% titanium dioxide, 3% Zinc Oxide and 0.5% of calcium stearate and a wire side HDPE/LDPE blend at a 46/54 ratio. Face and wire side resin coverages were approximately 25.88 g/m$^2$, and 27.83 g/m$^2$ respectively. An antistat layer was also applied to the backside resin.

Example 2 of the Invention comprises the same paper raw base used in Example 1 and coated with a different face side composition. The face side composition consisted of two resin coated layers. The first resin coated layer i.e. the one in contact with the paper, was made up of a face side composite comprising substantially 83% LDPE, 12.5% titanium dioxide, 3% Zinc oxide and 0.5% of calcium stearate at a coverage of 12.21 g/m$^2$. On top of this face side resin coat, was the pearlescent pigment containing resin layer extrusion coated at a coverage of 13.67 g/m$^2$. It was composed of 5% by weight Afflair 100 (a pearlescent pigment from EM Industries where the mica particle size ranged from 5 micrometer–60 micrometer, and the titanium dioxide coating on mica platelets was anatase) in low density polyethylene, specifically an Eastman Chemical grade D4002P. The wire side composition and coverage on the back of the element was kept the same as in Example 1.

Example 3 of the Invention is a variation of Example 2, where the pearlescent pigment concentration, and the titanium dioxide content in the face side composite has been decreased. The face side composition consisted of two resin coated layers. The first resin coated layer i.e. the one in contact with the paper, was made up of a face side composite comprising substantially 94.66% LDPE, 4.17% titanium dioxide, 1% Zinc oxide and 0. 17% of calcium stearate at a coverage of 12.21 g/m$^2$. On top of this face side resin coat, was the pearlescent pigment containing resin layer extrusion coated at a coverage of 13.67 g/m$^2$. This resin layer was composed of 2% by weight Afflair 100 (a pearlescent pigment from EM Industries, where the mica particle size ranged from 5 micrometer–60 micrometer, and the titanium dioxide coating on mica platelets was anatase) in low density polyethylene, specifically an Eastman Chemical grade D4002P. The wire side composition and coverage was kept the same as in Example 1. Example 3 had the same base and resin coverage as in example 2. In addition the image-receiving layer also had a small quantity of nacreous pigment incorporated in at least one larger. For the purpose of this invention, Afflair 110 pigment was dispersed in gelatin using typical mixing. The gel lay down was approximately 190 g/m$^2$, and the pigment weight was coated at 19.4 g/m$^2$ in the top most layer of a silver halide light sensitive emulsion. Typically this is known as the size overcoat layer. The coating layer was dried and then an image was exposed and developed using RA-4 chemistry.

The image base material examples may be coated with any image receiving layer.

TABLE 1

| Example | Inkjet | Photographic | Thermal Dye | Electrophotographic |
|---|---|---|---|---|
| Example1 (Control) | No | No | No | No |
| 2 | Yes | Yes | Yes | Yes |
| 3 | Yes | Yes | Yes | Yes |

No = Visual examination show no nacreous appearance
Yes = Visual examination shows a nacreous appearance Table 1 indicates that the nacreous appearance is not present when there is no nacreous pigment in or on the substrate but that when a nacreous pigment is incorporated in combination with an inkjet, photographic, thermal dye sublimation or electrophotographic image receiving layer that the nacreous appearance is in combination with the image. As indicated within the examples the nacreous appearance may be in or on the base substrate or in combination the image layer. It should be noted that image forming dyes or other materials should in general be organic based materials and or have a Status A reflection density of less than 2.0. Density greater than 2.0 will dampen nacreous appearance. Reflection density is the amount of light energy reflecting from the image to an observer's eye. Reflection density is measured by 0°/45° geometry Status A red/green/blue response using an X-Rite model 310 (or comparable) photographic transmission densitometer.

The invention has been described in detail with particular reference to certain preferred embodiments thereof, but it will be understood that variations and modifications can be effected within the spirit and scope of the invention.

What is claimed is:

1. An imaging element comprising at least two layers comprising nacreous pigment and polymer wherein said at least two layers comprising nacreous pigment have pigments of different size.

2. The imaging element of claim 1 further comprising a substrate.

3. The imaging element of claim 2 wherein at least one layer comprising a nacreous pigment is in the upper part of said substrate.

4. The imaging element of claim 3 wherein at least one layer comprising a nacreous pigment is the surface layer of said substrate.

5. The imaging element of claim 3 wherein at least one layer comprising a nacreous pigment is in at least one layer adjacent the surface layer of said substrate.

6. The imaging element of claim 1 wherein said nacreous pigment is present in said imaging element in an amount between 0.5 and 8% by volume of at least one layer comprising a nacreous pigment.

7. The imaging element of claim 1 wherein said at least one layer comprising a nacreous pigment has a ratio of layer thickness to average size of the longest dimension of said nacreous pigment of between 2 to 1 and 10 to 1.

8. The imaging element of claim 5 wherein said surface layer has a surface roughness of less than 0.8 $\mu$m.

9. The imaging element of claim 1 said at least two layers comprising nacreous pigment are coextruded layers.

10. The imaging element of claim 1 wherein said at least two layers comprising a nacreous pigment have said nacreous pigment in at least one image receiving layer and at least one resin coated layer comprising nacreous pigment and polymer.

11. The imaging element of claim 1 wherein said at least two layers comprising a nacreous pigment have pigments of different composition.

12. The imaging element of claim 1 wherein said nacreous pigments are selected from the group consisting of metal oxide coated mica, modified mica, fledspar, silicates and quartz.

13. The imaging element of claim 1 wherein said nacreous pigments are selected from the group consisting of silicates.

14. The imaging element of claim 1 wherein said nacreous pigments are selected from the group consisting of silicates having a coating which has a refractive index greater than 0.2 above the refractive index of said silicates.

15. The imaging element of claim 3 wherein there is at least one reflective layer below at least one layer comprising a nacreous pigment.

16. The imaging element of claim 1 wherein said nacreous pigment has a platelet or needle shape.

17. The imaging element of claim 1 wherein said imaging element has a nacreous appearance.

18. The imaging element of claim 16 wherein said nacreous pigment further comprises a metal oxide coating that consists of at least one member selected from oxide of titanium, aluminum, and barium.

19. The imaging element of claim 1 wherein at least one layer comprising nacreous pigment and polymer comprises polyolefin polymer.

20. The imaging element of claim 1 wherein at least one layer comprising nacreous pigment and polymer comprises a polymer selected from the group consisting of polyolefin, polyester, polycarbonate, polyamide and copolymer derivatives and blends thereof.

21. The imaging element of claim 1 wherein at least one layer comprising nacreous pigment and polymer is substantially free of pigment, other than the nacreous pigment.

22. The imaging element of claim 1 wherein said imaging element further comprises at least one layer that comprises white pigment below at least one layer comprising nacreous pigment and polymer.

23. The imaging element of claim 22 wherein said white pigment is selected from the group consisting of $TiO_2$, ZnO, ZnS, $BaSO_4$, $CaCO_3$, talc and clay.

24. An imaging element comprising at least two layers comprising nacreous pigment and polymer wherein said at least two layers comprising nacreous pigment have pigments of different composition.

25. The imaging element of claim 24 further comprising substrate.

26. The imaging element of claim 25 wherein at least one layer comprising a nacreous pigment is in the upper part of said substrate.

27. The imaging element of claim 26 wherein at least one layer comprising a nacreous pigment is the surface layer of said substrate.

28. The imaging element of claim 26 wherein at least one layer comprising a nacreous pigment is in at least one layer adjacent the surface layer of said substrate.

29. The imaging element of claim 26 wherein said nacreous pigment is present in said imaging element in an amount between 0.5 and 8% by volume of at least one layer comprising a nacreous pigment.

30. The imaging element of claim 26 wherein at least one layer comprising a nacreous pigment has a ratio of layer thickness to average size of the longest dimension of said nacreous pigment of between 2 to 1 and 10 to 1.

31. The imaging element of claim 28 wherein said surface layer has a surface roughness of less than 0.8 $\mu$m.

32. The imaging element of claim 24 said at least two layers comprising nacreous pigment are coextruded layers.

33. The imaging element of claim 25 wherein said at least two layers comprising a nacreous pigment have pigments of different size.

34. The imaging element of claim 24 wherein said nacreous pigments are selected from the group consisting of silicates having a coating which has a refractive index greater than 0.2 above the refractive index of said silicates.

35. The imaging element of claim 26 wherein there is at least one reflective layer below said at least one layer comprising a nacreous pigment.

36. The imaging element of claim 25 wherein said imaging element has a nacreous appearance.

37. The imaging element of claim 25 wherein said at least one layer comprising nacreous pigment and polymer comprises polyolefin polymer.

38. The imaging element of claim 25 wherein at least one layer comprising nacreous pigment and polymer is substantially free of pigment, other than the nacreous pigment.

39. The imaging element of claim 24 wherein said imaging element further comprises at least one layer that comprises white pigment below at least one layer comprising nacreous pigment and polymer.

40. The imaging element of claim 25 wherein said at least two layers comprising a nacreous pigment have said nacreous pigment in at least one image receiving layer and at least one resin coated layer comprising nacreous pigment and polymer.

* * * * *